United States Patent [19]

Ise et al.

[11] Patent Number: 4,865,521

[45] Date of Patent: Sep. 12, 1989

[54] VACUUM BREAKING DEVICE FOR EJECTOR PUMP

[75] Inventors: Yoji Ise; Akira Yamaguchi, both of Tokyo, Japan

[73] Assignee: Myotoku Ltd., Tokyo, Japan

[21] Appl. No.: 199,067

[22] Filed: May 26, 1988

[30] Foreign Application Priority Data

May 30, 1987 [JP] Japan ..... 62-84872

[51] Int. Cl.[4] ..... F04F 5/48

[52] U.S. Cl. ..... 417/187; 417/182

[58] Field of Search ..... 417/151, 162, 182, 185, 417/187, 189, 198; 248/205.8, 205.9, 362, 363

[56] References Cited

U.S. PATENT DOCUMENTS

| | | | |
|---|---|---|---|
| 3,052,479 | 9/1962 | Trell | 417/185 |
| 3,967,849 | 7/1976 | Cagle | 417/184 |
| 4,261,332 | 4/1981 | Stewart | 417/185 |
| 4,290,446 | 9/1981 | Seiler | 417/185 |
| 4,380,418 | 4/1983 | Crawford et al. | 417/185 |
| 4,402,651 | 9/1983 | Ise | 417/182 |
| 4,549,854 | 10/1985 | Yamamoto | 417/187 |
| 4,600,363 | 7/1986 | Ise et al. | 417/187 |
| 4,655,692 | 4/1987 | Ise | 417/187 |

*Primary Examiner*—Carlton R. Croyle
*Assistant Examiner*—Robert N. Blackmon
*Attorney, Agent, or Firm*—Biebel, French & Nauman

[57] ABSTRACT

A vacuum breaking device for an ejector pump is provided. The vacuum breaking device according to the present invention features that it is provided with a movable sealing valve for blocking the outlet port of the ejector hole of the pump when a vacuum generated in a system within the pump is be broken. The valve is arranged in opposite relationship with the ejector hole of the pump and shifts to block the outlet port due to the pressure of compressed air supplied to the air sucking chamber of the pump so that the leakage of the vacuum breaking compressed air from the ejector hole is prevented thereby increasing the efficiency of vacuum breaking operation. The vacuum breaking device is applicable to a vacuum sucking device for attracting and sucking an article so as to transfer it to a desired place.

1 Claim, 4 Drawing Sheets

VACUUM BREAKING DEVICE FOR EJECTOR PUMP

FIELD OF THE INVENTION

The present invention relates to a vacuum breaking device for breaking a vacuum generated by an ejector pump.

BACKGROUND OF THE INVENTION

In case a vacuum is generated in an ejector pump when compressed air is ejected into the ejector hole from the nozzle hole and air in the air intake chamber between the holes is sucked and discharged outside the chamber, the vacuum has to be broken by introducing the compressed air into the evacuated system when the operation of the pump is finished. However, the conventional method has had a disadvantage that sometimes the compressed air escapes into the atmosphere through the ejector hole so that an effective vacuum breaking operation is hindered.

SUMMARY OF THE INVENTION

The present invention has been made to eliminate the above-described disadvantage of the conventional method. That is, according to the present invention, there is provided a vacuum breaking device for an ejector pump. The ejector pump is provided with a sealing valve operating such that when the vacuum breaking compressed air is applied, the sealing valve shifts due to the pressure of the compressed air to block the outlet port of the ejector hole allowing the compressed air to be fully supplied into the evacuated system so that residual negative pressure is securely removed.

Accordingly, an object of the present invention is to provide a vacuum breaking device for an ejector pump, which is provided with a movable sealing valve capable of preventing the leakage of compressed air into the atmosphere by blocking the outlet port of the ejector pump when a vacuum generated in a system connected to the pump is broken, whereby an effective vacuum breaking operation is performed.

Another object of the present invention is to provide a vacuum breaking device which is applicable to a vacuum sucking device for transferring an article to a desired place.

BRIEF DESCRIPTION OF HE DRAWINGS

The present invention will now be described with reference to the accompanying drawings wherein.

DETAILED DESCRIPTION OF THE INVENTION

Figure 1:
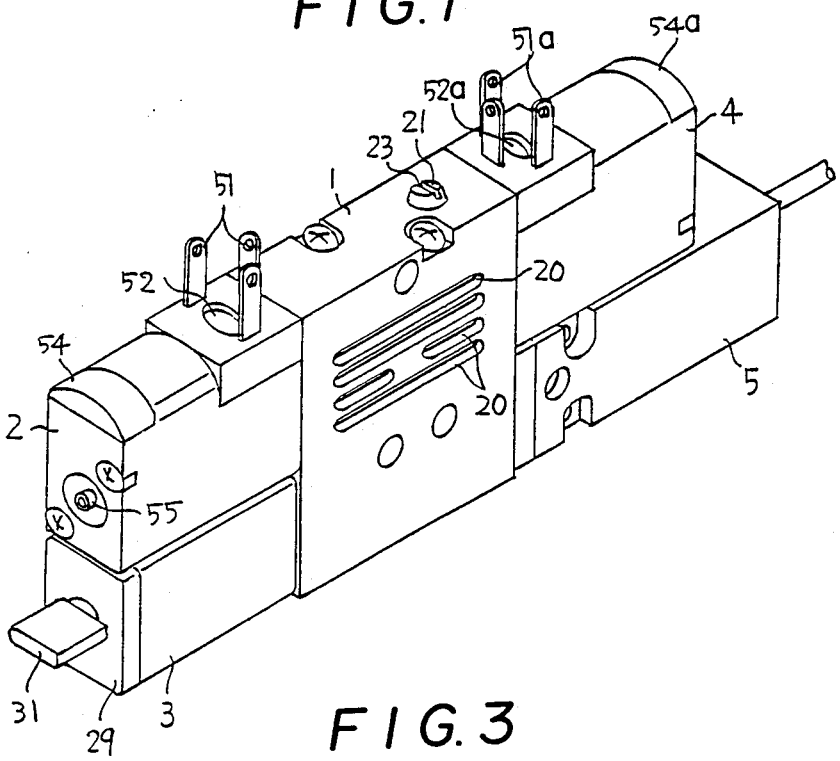
FIG. 1 is a perspective view of a preferred embodiment of a vacuum breaking device for an ejector pump according to the present invention.

Referring to FIG. 1, the vacuum breaking device of the present invention mainly comprises a pump 1 attached on both sides thereof with a vacuum generating electromagnetic valve 2, a filter 3, a vacuum breaking electromagnetic valve 4 and a vacuum switch 5 through suitable sealing members (not shown).

Figure 3:
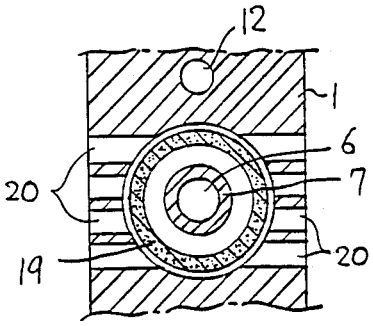
FIG. 3 is a partial sectional view of the ejector pump shown in FIG. 1.
Figure 2:
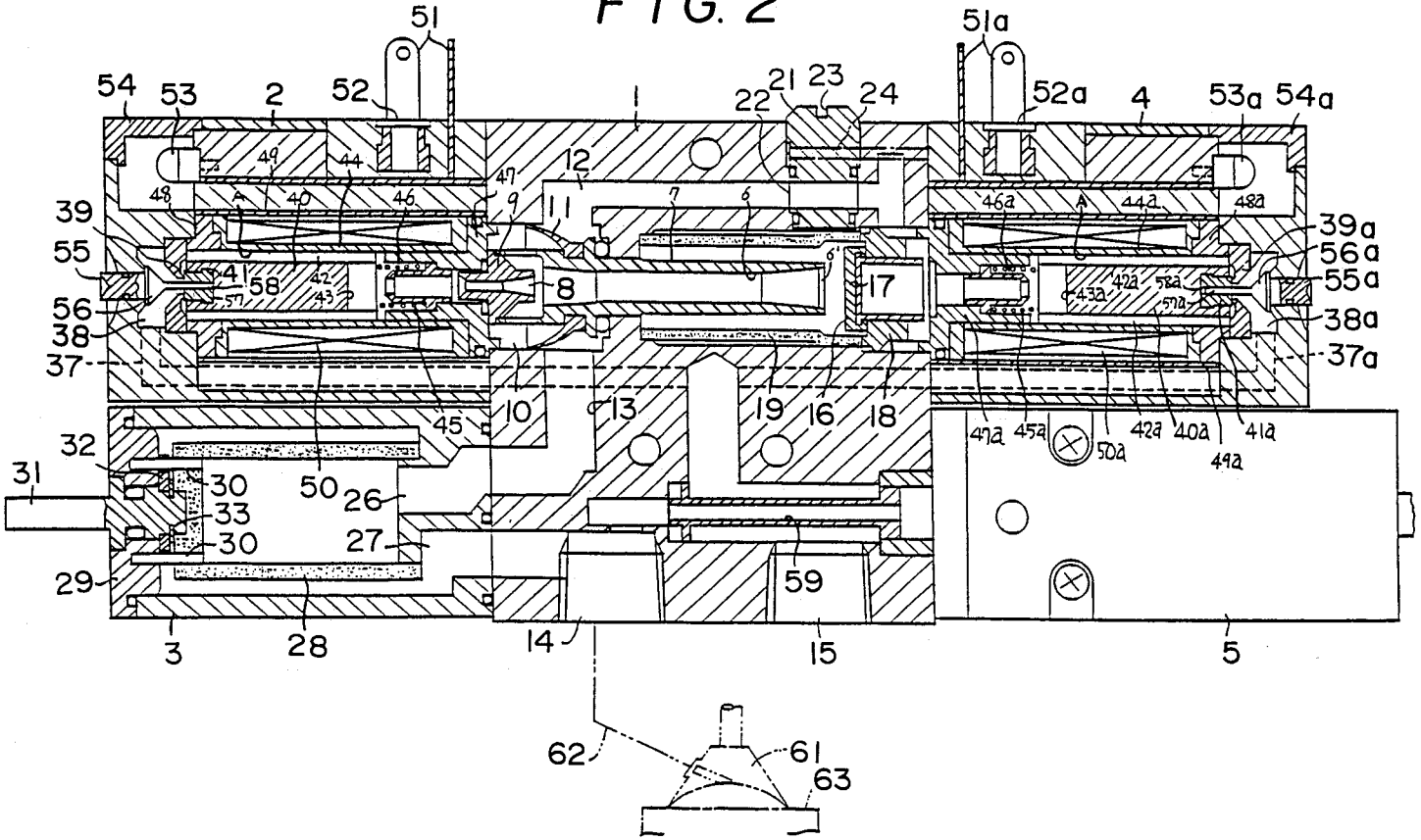
FIG. 2 is a vertical sectional front view of the device shown in FIG. 1.
Figure 4:
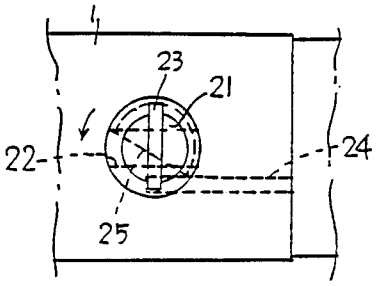
FIGS. 4 and 5 are plan views, respectively, illustrating an operation of a vacuum breaking flow rate adjusting valve forming part of the device shown in FIG. 1.
Figure 5:
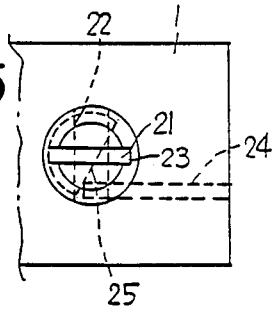

As shown in FIG. 2, the pump 1 is provided with an ejector block 7 having an ejector hole 6 and a nozzle block 9 having a nozzle hole 8 both of which blocks are located within a longitudinal aperture drilled through the pump 1 and an air intake chamber 10 is formed between the nozzle hole 8 and the ejector hole 6. Further, on one side of the air intake chamber 10 there is provided a conical and elastic vacuum keeping valve 11 fitted on the ejector block 7 and the chamber 10 is in communication with upper and lower vent holes 12 and 13. As shown, the lower vent hole 13 communicates with an air intake port 14 through the filter 3 and the upper vent hole 12 communicates with a compressed air inlet port 15 through the vacuum breaking electromagnetic valve 4. Facing an outlet end 6' of the ejector hole 6 there is provided a sealing valve 16 having an elastic valve head 17 made of rubber or synthetic resin material and capable of shifting to a position at which it blocks the outlet end of the ejector hole 6. The cross-section of a tubular portion (right side in FIG. 2) of the sealing valve 16 is made wider than that of the opening end 6' of the ejector hole 16 so that when compressed air is introduced into the right side of the valve 16, the valve 16 shifts toward the ejector hole 6 overcoming the pressure of the compressed air ejected from the ejector hole 6 and further, when the compressed air is supplied only from the ejector hole 6, the valve 16 shifts in a direction in which it leaves away from the outlet end 6' of the ejector hole 6. Around the ejector block 7, there is provided a tubular silencer 19 sandwiched between a stepped portion of the pump body and the right side fitting portion 18. The silencer 19 is made by sintering polypropyrene powder or of a suitable air permeable noise suppressing material and at the outside of the silencer 19, there are formed a plurality of through holes 20 in the pump 1 as shown in FIGS. 1 and 3 for discharge exhaust air from the ejector hole 6. Adjacent the vent hole 12 in the upper part of the pump 1, there is provided a vacuum breaking compressed air flow rate adjusting valve 21. The adjusting valve 21 has an adjusting hole 22 capable of communicating with the vent hole 12 and an engagement groove 23 on the upper surface thereof and is prevented from slipping off the pump 1 by means of a pin 24 inserted sideward therethrough. Further, a recess 25 is formed in the side surface of the valve 21 at a position corresponding to the pin 24 so that the valve 21 is rotated by inserting a suitable jig such as a screw driver into the engagement groove 23 until both ends of the recess 25 come into contact with the pin 24 to bring about a state in which the adjusting hole 22 is in communication with the vent hole 12 (as shown in FIGS. 2 and 4) and a state in which the adjusting hole 22 is out of communication with the hole 12 as it stands substantially normal to the hole 12 (FIG. 5).

Figure 6:
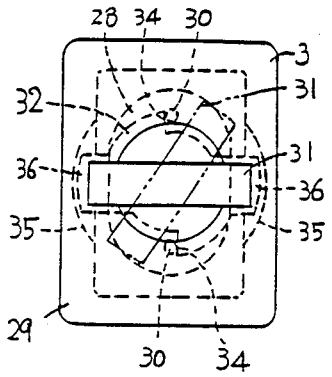
FIG. 6 is a side view of a filter forming part of the device shown in FIG. 1.

The filter 3 has a vent hole 26 communicating with the vent hole 13 and a vent hole 27 communicating with the air intake port 14, and a tubular filter element 28 is arranged between the holes 26 and 27. The filter element 28 is formed by sintering polypropyrene powder so as to have sufficient air permeability but it may be made of other suitable materials. Further, one end of the filter element 28 is supported by fixing pins 30 fitted into a cover 29 at the left side of the pump 1. The cover 29 is fitted with a locking knob 31 and a locking plate 32 is fixed inside the knob 31 by means of a snap-ring 33. As shown in FIG. 6, the locking plate 32 is provided with engaging claws 36 to engage with grooves 35 formed inside the filter 3, and edges 34 engaging the pins 30. Thus, when the locking knob 31 is rotated to the position shown by a chain-line in FIG. 6, the engaging claws 36 of the locking plate 32 are disengaged from the engagement grooves 35 so that the cover 29 and the filter element 28 can be removed from the filter 3 for cleaning the element 28 or replacing it with new one. On the other hand, when the locking knob 31 is returned to the position shown by a solid-line in FIG. 6, the filter element 28 can be remounted. Further, the filter 3 is made of a transparent synthetic resin material such as polycarbonate so as to make it possible to observe if the filter element 28 is filthy.

Figure 7:
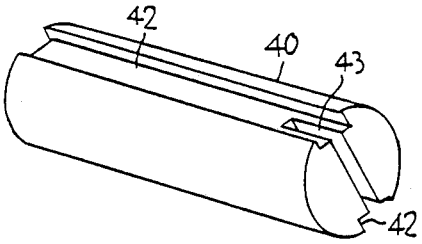
FIGS. 7 and 8 are perspective views, respectively, showing both ends of a plunger of a vacuum generating electromagnetic valve forming part of the device shown in FIG. 1.
Figure 8:
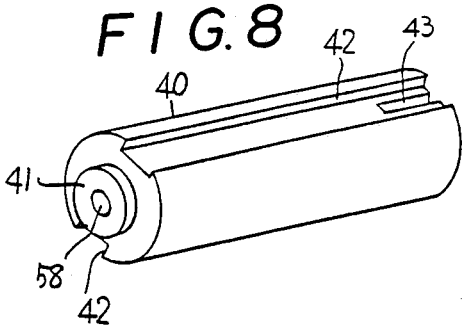

The vacuum generating electromagnetic valve 2 has a vent hole 37 communicating with the compressed air inlet port 15 and opening in a fluid chamber 38. The fluid chamber 38 is provided with a valve seat 39 and a plunger 40 faces the valve seat 39. The plunger 40 has, at one end thereof, an elastic valve head 41 made of rubber or synthetic resin material, a pair of longitudinally extending elongated grooves 42 formed in the outer periphery thereof and a vertical groove 43 on the end opposite the valve head 41 so as to communicate with the grooves 42 (See FIGS. 7 and 8). The plunger 40 is slidably fitted in a valve chamber A formed in a tubular section of a bobbin 44 and is urged by a spring 45 in a direction in which the valve head 41 comes into contact with the valve seat 39. Facing the plunger 40, there is provided an inner valve seat 46 which corresponds in position to the nozzle hole 8 of the nozzle block 9. Further, the inner valve seat 46 is fitted in a center post 47 and at one end of the bobbin 44 facing the center post 47, there is provided a plate upper 48. The outer peripheries of the center post 47 and the plate upper 48 are covered by a housing 49 and a solenoid 50 is received between the housing 49 and the bobbin 44.

The plunger 40, housing 49 and center post 47 are all made of martensite stainless steel and other magnetic materials and when the solenoid 50 is excited, the plunger 40 is attracted to the center post 43 to shift to the right as shown against the spring 45. Further, the electromagnetic valve 2 is provided with a power supply terminal 51, a connecting hole 52 and a lighting section comprising a LED element 53 and an acrylic resin lens 54 arranged outside the former and lighting up at the time of power supply. At the outside of the electromagnetic valve 2 there is provided a manual operation button 55 which has a large-diametered portion therein positioned in the fluid chamber 38 and an operating rod 57 extending toward the plunger 40 through the valve seat 39. As shown, the operating rod 57 passes through a small hole 58 drilled in the valve head 41 and when the button 55 is pressed, the top end of the operating rod 57 comes into contact with the bottom of the valve head 41 so that the plunger 40 shifts to the right thereby opening the valve hole. Further, when the button 55 is released, compressed air acts on the large-diametered portion 56 of the button so that the button moves to the left to assume its original position.

The vacuum breaking electromagnetic valve 4 is of the same structure as the vacuum generating electromagnetic valve 2 so that parts of the valve 4 corresponding to those forming the valve 2 are designated by the same reference numerals each, however, added with the letter "a" throughout the drawings for the sake of convenience of illustration. Further, an inner valve seat 46*a* faces the sealing valve 16 and communicates with the vent hole 12 of pump 1 through the flow rate adjusting valve 21.

The vacuum switch 5 is in communication with the air intake port 14 through a flow passage 59 and as is well known, opens and closes so as to control the vacuum generating electromagnetic valve depending on the degree of vacuum acting on the air intake port 14.

Figure 9:
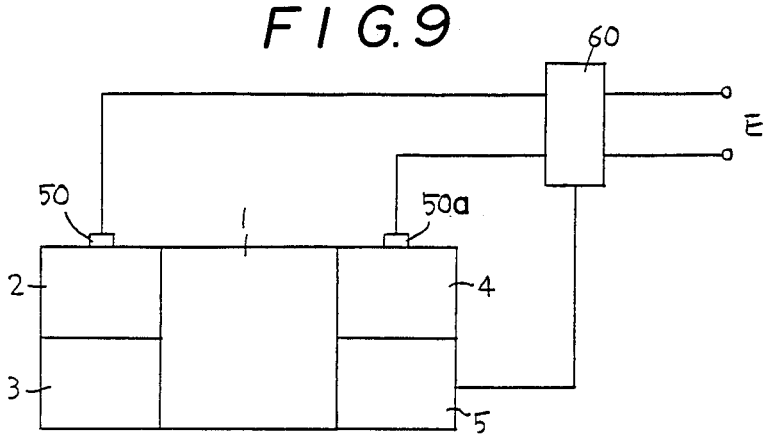
FIG. 9 is a wiring diagram for driving the device according to the present invention.
Figure 10:
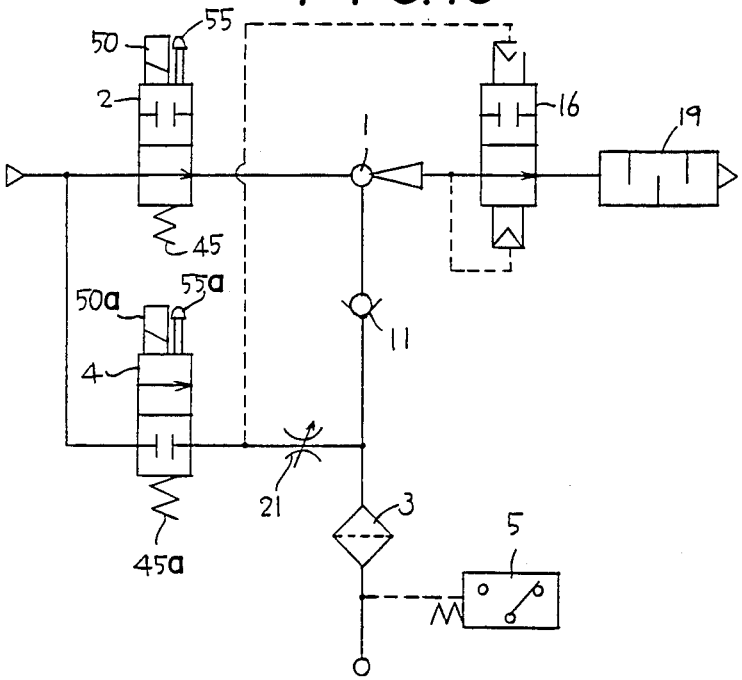
FIG. 10 is a pnuematic circuit diagram used for the device according to the present invention.

The solenoid 50 of the vacuum generating electromagnetic valve 2, the solenoid 50*a* of the vacuum breaking electromagnetic valve 4; and the vacuum switch 5 are connected to a control device 60 connected to a power source E as shown in FIG. 9 and operates in the following manner:

Referring to FIG. 10 which shows a pneumatic circuit diagram and FIG. 2, the valve seat 39 is shown contacting with the valve head 41 to close the valve hole, no compressed air is supplied to the nozzle hole 8 but when the solenoid 50 of the electromagnetic valve 2 is excited, the plunger 40 shifts to the right to open the valve hole so that the compressed air enters the elongated grooves 42 of the plunger 40 from the air inlet port 15 via the vent hole 37 and the inner valve seat 46, thereby sucking and discharging air from the air intake chamber 10. Consequently, the system including the vent holes 13, 26, the filter 28 and the air intake port 14 is evacuated. Therefore, if, for example, a vacuum disk 61 of a vacuum sucking device is connected to the air intake port 14 through the conduit 62, the pressure in the disk 61 is reduced enabling an article 63 to be attracted to the disk for transferring it to a desired place. When a predetermined negative pressure is reached in the evacuated system, the vacuum switch 5 operates to release the excitation of the solenoid 50 and the plunger 40 shifts to the left by the action of the spring 45 to close the valve hole so that the injection of the compressed air is stopped but since the system is kept at a predetermined negative pressure, the consumption of the compressed air is saved. When the degree of vacuum decreases due to the leakage of air, the vacuum switch 5 senses it to allow the compressed air to be re-ejected again thereby increasing the degree of vacuum in the system.

After transferring the article 63 to the desired place, the excitation of the solenoid 50 of the vacuum generating electromagnetic valve 2 is released and when the solenoid 50*a* of the vacuum breaking electromagnetic valve 4 is excited, the plunger 40*a* shifts to the left to open the valve hole so that the compressed air is supplied to the air intake port 14 from the air inlet port 15 via the vent holes 37*a* and 12 thereby cancelling the negative pressure in the sucking disk 61. In this case, the compressed air tends to flow into the atmosphere from the ejector hole 6 but the vacuum breaking compressed air has already acted on the sealing valve 16 before it reaches the vent hole 12 so that the sealing valve 16 moves to the left by overcoming the resistance of the injected compressed air from the ejector hole 6 thereby blocking the outlet end 6' and preventing the compressed air from flowing through the ejector hole. Accordingly, the compressed air is supplied to the air intake port 14 without any loss, which results in the advantages that the negative pressure can be released quickly and securely, the article transfer operation can be securely performed and the amount of consumption of the compressed air can be minimized. The feeding time and amount of compressed air can be adjusted by the control device 60 and the flow rate adjusting valve 21.

Further, it should be noted that the solenoids 50 and 50*a* may be substituted with the manual operation buttons 55 and 55*a*.

As described above, the present invention has advantages that when a vacuum is broken, the vacuum sucking action is instantaneously released without any loss of the compressed air and therefore, the article transfer operation can be efficiently performed.

It should be noted that although the present invention has been described based on a preferred embodiment thereof, various modifications and alterations can be made without departing from the spirit and scope of the invention.

What is claimed is:

1. In an ejector pump in which compressed air is injected into an ejector hole 6 from a nozzle hole 8 to suck air in an air intake chamber 10 formed between said nozzle hole 8 and ejector hole 6 and discharge the same into the atmospheric through an outlet end 6' of said ejector hole 6 and evacuate said air intake chamber 10 and the system connected thereto through an air intake port 14, and in which compressed air is injected into the system to promote the releasing of the vacuum in said system when the sucking operation is finished, the improvements for said vacuum breaking device comprising a movable sealing valve 16 positioned in facing relationship to said outlet end 6' of said ejector hole 6 and movable between a position in which it blocks said end 6' and a position in which it is spaced from said end 6', said sealing valve 16 having a cross-section which is larger than that of the outlet end 6' so that when the pressure of the vacuum breaking compressed air is applied thereto on the side thereof remote from said end 6' the sealing valve moves to seal said outlet end 6' of said ejector hole 6 against the pressure of the compressed air ejected from the ejector hole 6, preventing the leakage of compressed air from said ejector hole, said vacuum breaking compressed air being connected to said air intake chamber when said sucking operation is finished.

* * * * *